US009226606B1

(12) United States Patent
Nesladek

(10) Patent No.: US 9,226,606 B1
(45) Date of Patent: Jan. 5, 2016

(54) BERET DISPLAY APPARATUS

(71) Applicant: Lucas J. Nesladek, Denver, CO (US)
(72) Inventor: Lucas J. Nesladek, Denver, CO (US)

( * ) Notice: Subject to any disclaimer, the term of this patent is extended or adjusted under 35 U.S.C. 154(b) by 0 days.
(21) Appl. No.: 14/453,348
(22) Filed: Aug. 6, 2014
(51) Int. Cl.
*A47G 25/10* (2006.01)
*A47F 7/06* (2006.01)
(52) U.S. Cl.
CPC .. *A47G 25/10* (2013.01); *A47F 7/06* (2013.01)
(58) Field of Classification Search
CPC ..... A47G 25/10; A47F 7/06; A47F 7/065
USPC ..... 211/30, 33; D6/552; 135/20.1; 206/8, 9
See application file for complete search history.

(56) References Cited

U.S. PATENT DOCUMENTS 361,833 A * 4/1887 Newman ..... A45C 11/02 2/175.4
381,016 A * 4/1888 Hollyday ..... A47F 7/06 206/8
503,949 A * 8/1893 Crouch ..... A47G 25/10 211/32
621,023 A * 3/1899 Boas ..... A47F 7/06 211/32
1,168,989 A * 1/1916 Zitka ..... A42B 1/002 211/23
1,541,133 A * 6/1925 Forti ..... A42B 1/002 211/30
1,698,633 A * 1/1929 Jimenez ..... A47G 25/10 211/33
1,710,478 A * 4/1929 Hoppin ..... A47F 7/06 211/181.1
1,746,486 A * 2/1930 Martin ..... A47G 25/10 211/105
1,746,487 A * 2/1930 Martin ..... A47G 25/10 211/196
1,837,692 A * 12/1931 Thomas ..... A47G 25/10 211/106.01
1,882,727 A * 10/1932 Augustin ..... A47G 25/06 211/32
1,886,752 A * 11/1932 Stansberry ..... A47F 7/06 211/33
1,965,773 A * 7/1934 Jacobs ..... A47G 25/10 211/30
1,969,716 A * 8/1934 Cohen ..... A47F 7/06 211/33
1,993,399 A * 3/1935 Cohen ..... A47G 25/10 211/33
2,034,924 A * 3/1936 Simon ..... A47F 7/06 211/32
2,094,810 A * 10/1937 Oppenheimer ..... A47F 7/06 211/166
2,283,373 A * 5/1942 Krafft ..... B65H 49/06 242/130.1
2,310,439 A * 2/1943 Johnson ..... A47F 5/08 211/32
2,474,458 A * 6/1949 Beaudoin ..... A45C 11/02 206/9
3,300,108 A * 1/1967 Schumer ..... A45D 44/14 206/8
3,447,726 A * 6/1969 George ..... A45D 44/14 132/54
3,464,603 A * 9/1969 Hunter ..... A45D 44/14 211/30
3,465,927 A * 9/1969 Belokin, Jr. ..... A45D 44/14 206/8
3,602,372 A * 8/1971 Verrecchio ..... A47F 7/065 206/8
3,754,662 A * 8/1973 Prinz ..... A47F 8/00 108/101
6,112,909 A * 9/2000 Moseley ..... A47F 5/0807 211/30
6,578,716 B1 * 6/2003 Wei ..... A47F 7/06 206/9
7,168,577 B1 * 1/2007 Moseley ..... A47G 25/10 211/32
7,959,018 B2 * 6/2011 Flickinger ..... A47F 7/06 211/30
8,381,413 B2 * 2/2013 Smith ..... F26B 25/003 211/116
8,950,591 B1 * 2/2015 McDowell ..... A45D 44/14 211/13.1
2007/0181515 A1 * 8/2007 Levi ..... A47F 7/00 211/85.3
2011/0132856 A1 * 6/2011 Meeks ..... A47F 3/14 211/85.3

* cited by examiner

*Primary Examiner* — Michael Safavi
(74) *Attorney, Agent, or Firm* — Leyendecker & Lemire, LLC

(57) ABSTRACT

A beret display apparatus is described. Embodiments of the beret display apparatus can generally include a base, a rod, and a member. The member can be adapted to wear a beret. For instance, the member can display a military style beret in an "as worn" presentation. The rod can be included to elevate the member and couple the member to the base. Generally, the rod can be coupled to the member in an offset position. By offsetting the member, a standard military style beret can appear centered on the base.

20 Claims, 6 Drawing Sheets

BERET DISPLAY APPARATUS

BACKGROUND

Currently, berets are typically displayed flat in display cases that are not meant for displaying berets. The display cases do not help achieve a distinct shape when initially forming the beret. Further, current display cases do not provide a platform to maintain the shape of the beret when not in use and display the beret in an "as worn position." Current display cases result in berets being misshaped, berets being stored away and becoming disfigured, and berets being displayed flat and unrecognizable.

An apparatus is needed to address these deficiencies and provide a much needed alternative to current practices.

DETAILED DESCRIPTION

Figure 1:
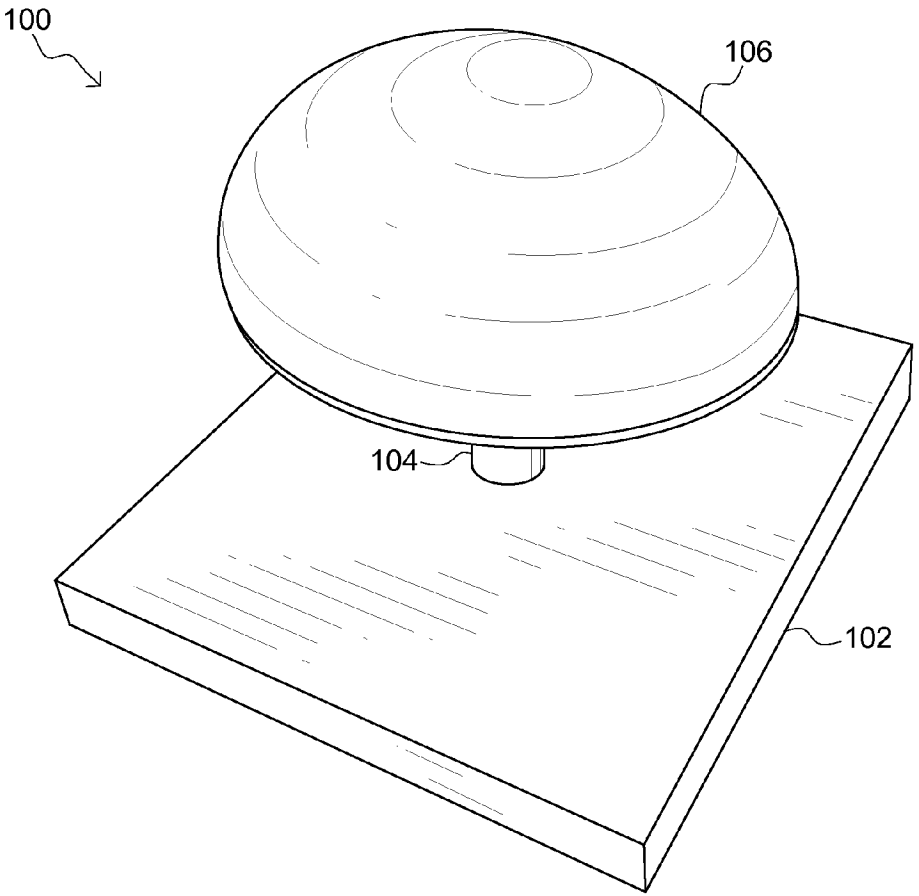
FIG. 1 is a perspective view of a beret display apparatus according to one embodiment of the present invention.

Embodiments of the present invention include a beret display apparatus. Generally, the beret display can include a base, a post, and a domed member. The domed member can be implemented to display a beret in an "as worn" presentation. In one embodiment, ends of the post can be removably coupled to the base and the domed member. Since a beret is typically not symmetrical, the post can be centered on the base and coupled offset to the domed member to make the beret appear centered when displaying the beret.

Embodiments of the beret display include a multipurpose platform that can (i) act as a template when forming a beret, (ii) be a structure to obtain and/or maintain a distinct shape of a beret, and (iii) act as a display for showcasing a beret as the beret is meant to be seen in an "as worn" presentation. The beret display can accommodate numerous sizes and unique characteristics associated with berets. Further, the beret display can facilitate ease of use, optimal fit, aesthetic symmetry, and recognition of berets.

Generally, the beret display apparatus can include a first size and a second size for the domed member. For instance, the domed member can be manufactured in a small/medium size and in a large/extra large size. Some embodiments can include sizing strips adapted to increase a perimeter length of the domed member. Typically, a user can implement the sizing strips to customize a fit of their beret to the domed member.

Embodiments of the beret display can accommodate up to ten different beret sizes. For instance, the beret display can accommodate beret sizes ranging from 6¾ to 7⅞. These sizes can include berets having an inside circumference of 21¼" to 24⅝".

In some embodiments, the beret display can include a transparent housing. For instance, the housing can be manufactured from materials including, but not limited to, glass and plastic. Generally, the housing can be adapted to fit onto the base and enclose the rod, the member, and a beret being worn by the member. The housing can be implemented to provide protection for a beret being presented by the beret display apparatus.

The shape, circumference, and manufactured offset of the beret display apparatus can provide symmetrical structure and proportional space distribution to a beret when displayed by the beret display apparatus.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

An Embodiment of a Beret Display Apparatus

Referring to FIG. 1, a detailed diagram of an embodiment 100 showing a beret display apparatus is illustrated. The beret display apparatus 100 can typically be implemented to showcase a beret in an "as worn" appearance. The beret display apparatus 100 can also be implemented to help form a beret.

As shown in FIG. 1, the beret display 100 typically includes a base 102, a rod 104, and a member 106.

Typically, the base 102 can be implemented to provide support for the rod 104 and the member 106. In one embodiment, the base 102 can have a substantially square shape. It is to be appreciated that the base 102 can have a plurality of different shapes without exceeding a scope of the present invention. For instance, the base 102 can have shapes including, but not limited to, triangular, rectangular, and circular. Generally, the base 102 can be manufactured from a rigid material including, but not limited to, a metal, a polymer, stone, glass, wood, and wood composites. In one embodiment, the base 102 can be manufactured from wood. For example, the wood can include a 6/4 African mahogany with a gunstock stain and polyurethane clear finish. In another example, the wood can be treated with a clear protective finish. It is to be appreciated that the base can be manufactured from a variety of materials each having a variety of different finishes.

The rod 104 can be implemented as a post to elevate the member 106. In one embodiment, the rod 104 can have a substantially cylindrical shape. It is to be appreciated that the rod 104 can have a plurality of different shapes and lengths without exceeding a scope of the present invention. Generally, the rod 104 can be manufactured from a rigid material including, but not limited to, wood, metal, polymers, and glass. For instance, to provide an illusion that a beret is floating in air, the rod 104 can be manufactured from solid clear acrylic.

In a typical embodiment, the rod 104 can be removably coupled to the base 102 and the member 106. For instance, the base 102 and the member 106 can each include an aperture adapted to receive the rod 104. In another instance, the rod 104 can be coupled to the base 102 and the member 106 by a fastener. It is to be appreciated that the rod 104 can be coupled to the base 102 and the member 106 by a variety of means and in a variety of combinations. In one embodiment, the rod 104 can be permanently coupled to the base 102 and removably coupled to the member 106. For instance, the rod 104 can be manufactured as part of the base 102 and the member 106 can be removably coupled to the rod 104.

To display a beret, the member 106 can be implemented to provide a platform for the beret to rest on. Generally, the member 106 can provide symmetrical structure to a beret while being displayed and can be implemented to form the beret.

In one embodiment, the member 106 can have a domed shaped with a substantially elliptical cross-section. The member 106 can generally include an aperture 108, shown generally in FIG. 6, for receiving the rod 104. In one embodiment, a center of the aperture 108 can be located approximately a ¼" off center along a lateral width of the member 106. It is to be appreciated that the aperture 108 can be located nearer or further from a middle of the lateral width of the member 106. Depending on a size of the rod 104, the aperture 108 can be sized to snugly receive the rod 104.

Figure 2:
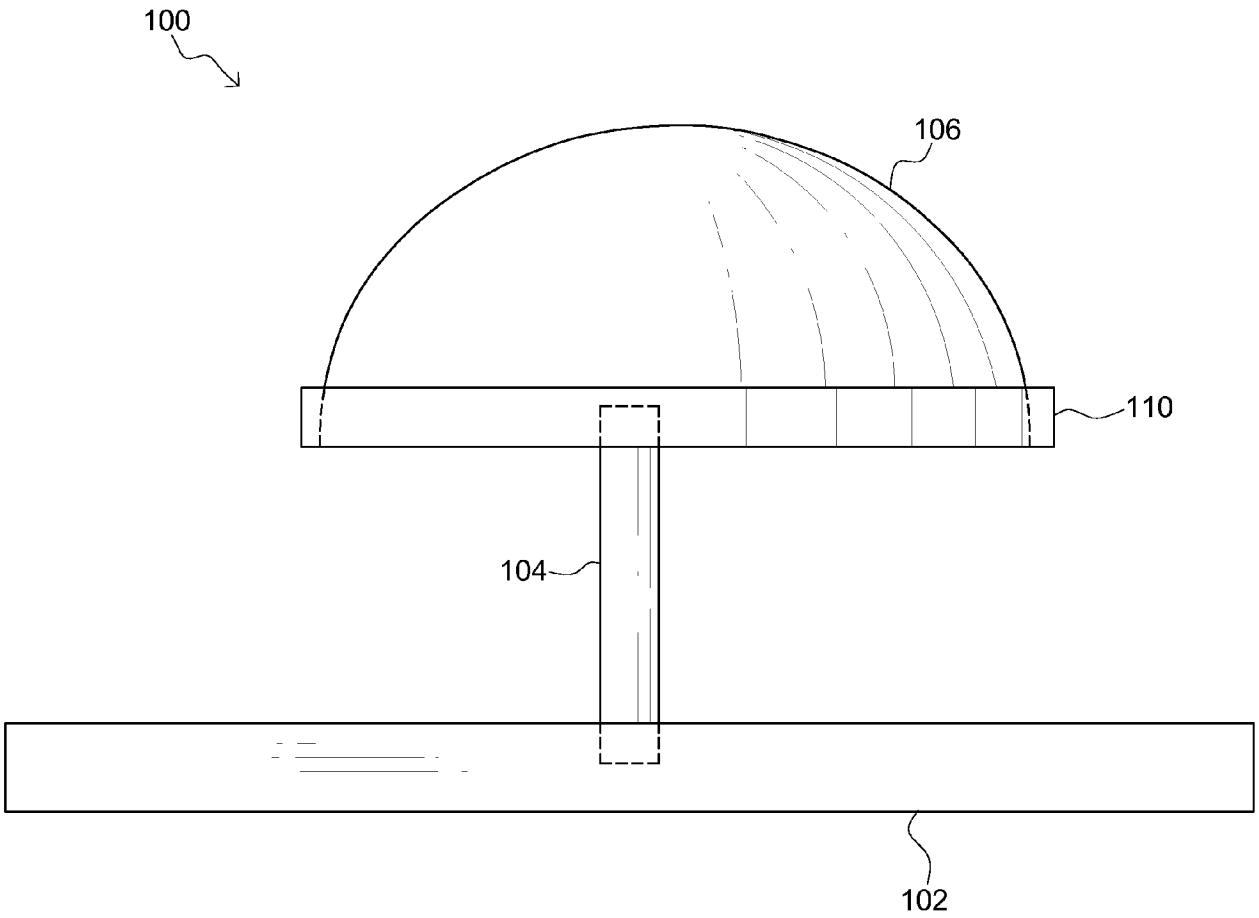
FIG. 2 is a front view of a beret display apparatus according to one embodiment of the present invention.

Referring to FIG. 2, a detailed diagram of the display apparatus 100 with a strip 110 is illustrated. Generally, the strip 110 can be flexible and be implemented to increase a circumference of the member 106. For instance, the strip 110 can be a sizing strip. Depending on a size of a beret, a user can attach the sizing strip 110 to the member 106 to provide a better fit of the beret to the member 106. In one embodiment, the sizing strip 110 can be a closed cell foam strip having a pressure sensitive adhesive on one side of the strip 110. The strip 110 can generally be manufactured from flexible materials. In one embodiment, the strip 110 can have a thickness ranging between ⅛" to 3/16" and a ¾" width. Generally, the strip 110 can be coupled around an entire circumference of the member 106. It is to be appreciated that the strip 110 can be coupled to the member 106 in different ways to achieve the same effect of increasing a circumference of the member 106.

Figure 3:
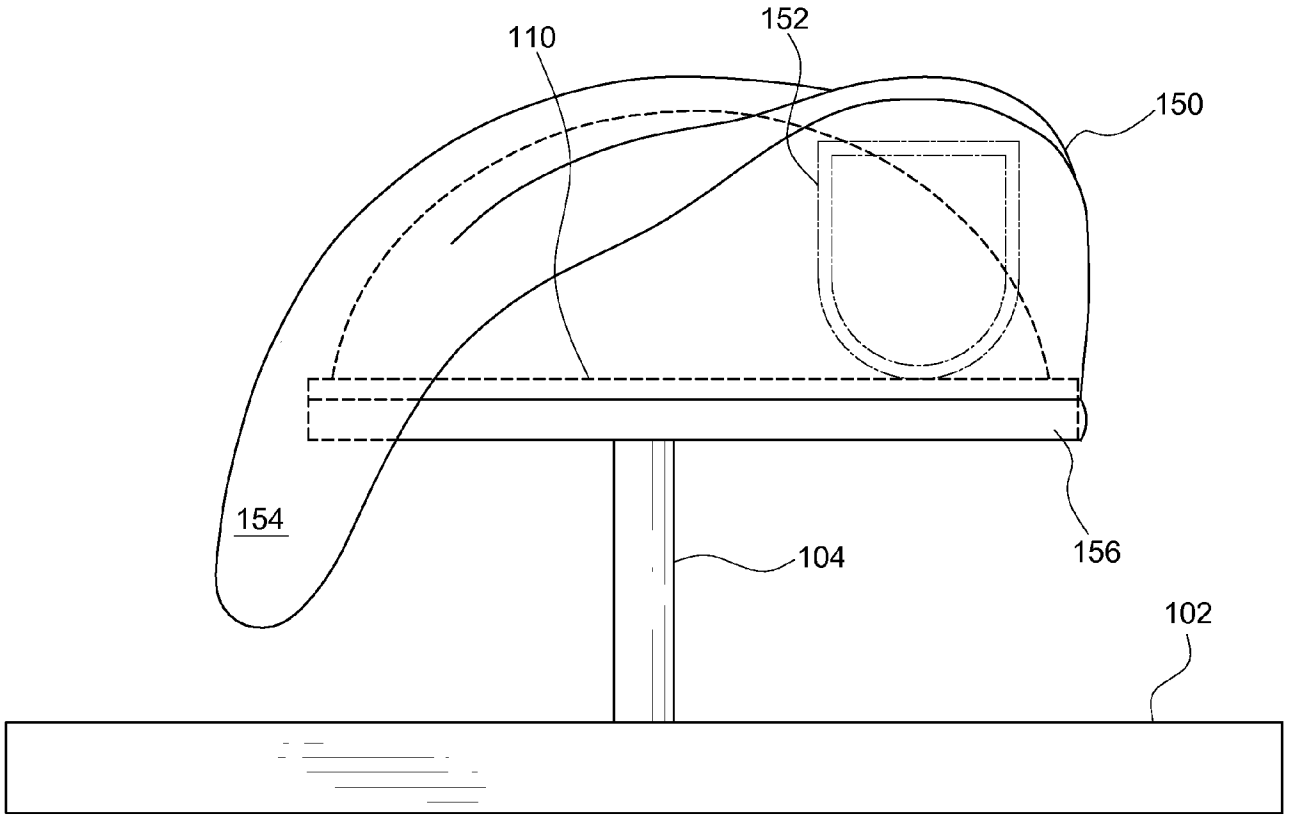
FIG. 3 is a front view of a beret display apparatus with a beret according to one embodiment of the present invention.

Referring to FIG. 3, a detailed diagram of the display apparatus 100 with a beret 150 is illustrated. As shown, the beret 150 can appear to be centered in relation to the base 102 with excess material of the beret 150 hanging off on the left side.

The beret 150, as shown in FIG. 3, is being displayed "as worn" and shaped in accordance with US Army Regulation AR 670-1 (para 3-5a(2)) and/or US Air Force Regulation AFI 36-2903 6.2.5.1. The beret 150 is representative of a beret manufactured in accordance with Military Specification MIL-B-43172E. For instance, an overall height of the beret 150 can be approximately 3" for a small size and approximately 3¼" for a large size. For illustrative purposes only, a unit patch 152 is illustrated and can generally have a height of approximately 2¼". It is to be appreciated that not all berets include unit patches. The draped excess material 154 can be approximately ½" and a height of a headband 156 can be between approximately ⅜" to ½".

Figure 4:
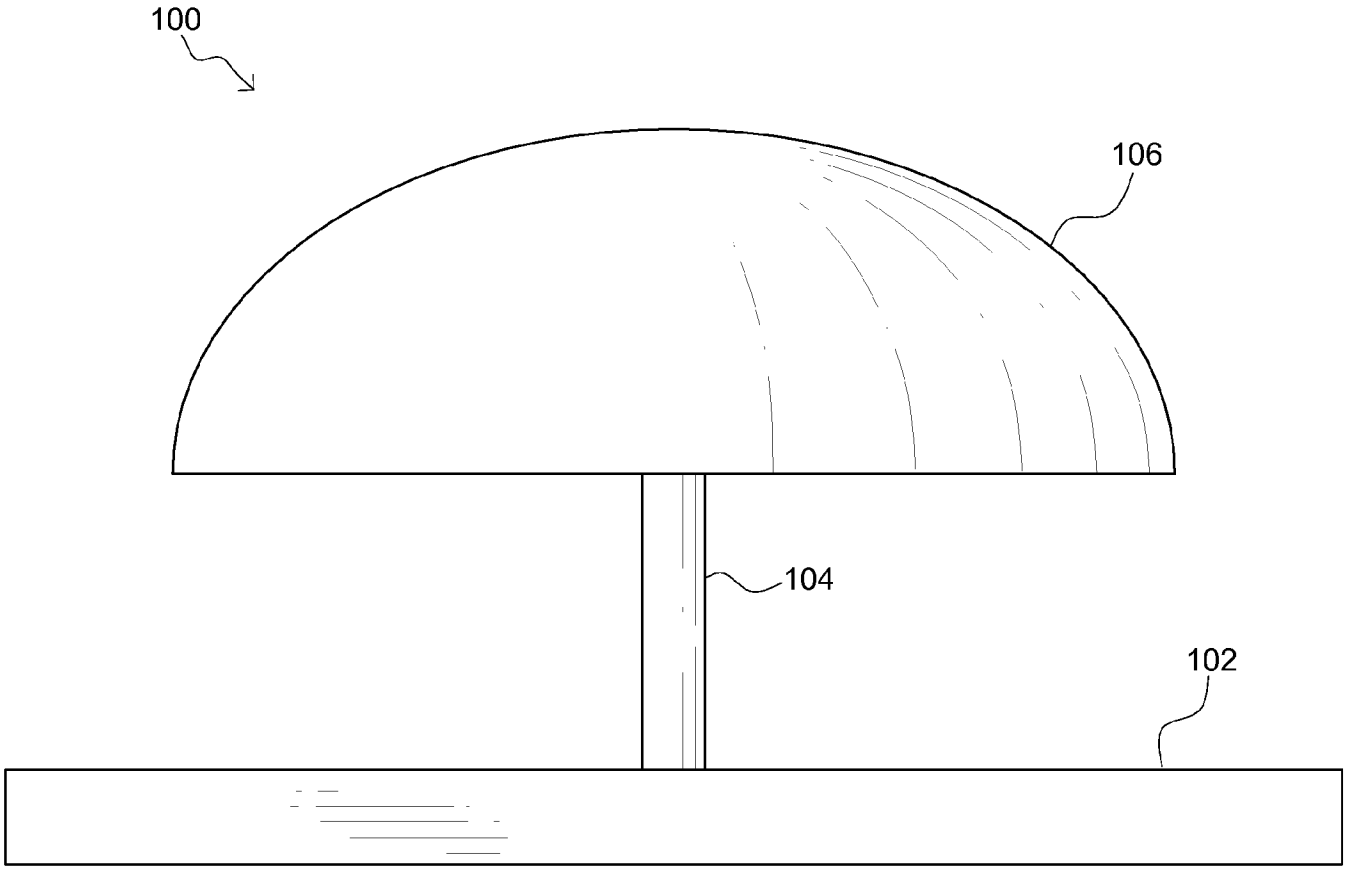
FIG. 4 is a side view of a beret display apparatus according to one embodiment of the present invention.
Figure 5:
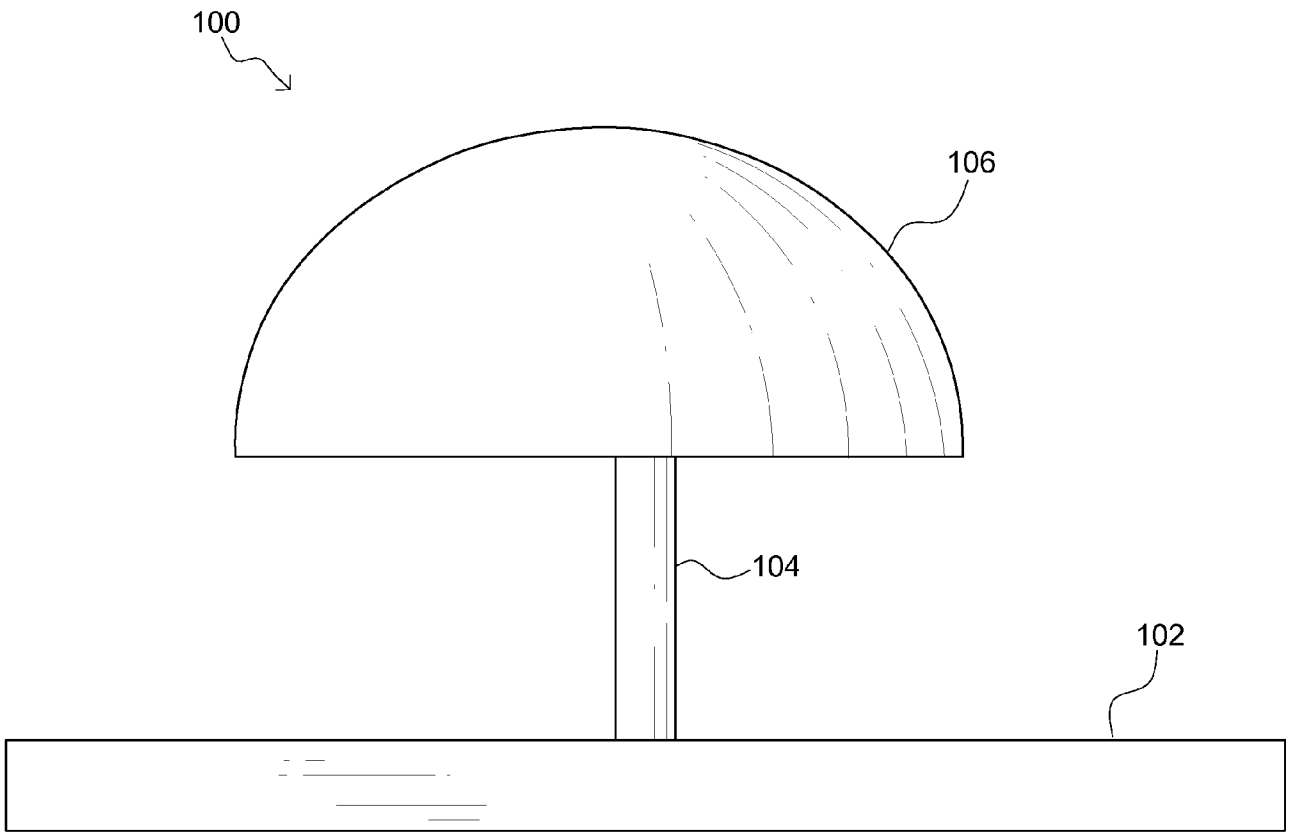
FIG. 5 is a back view of a beret display apparatus according to one embodiment of the present invention.

Referring to FIGS. 4 and 5, a side view of the display apparatus 100 and a back view of the display apparatus 100 are illustrated, respectively. As shown in FIGS. 1 and 4, the display apparatus 100 can generally be symmetrical. For instance, a proximal side and a distal side of the apparatus 100 can be mirror images of each other. As shown in FIGS. 2 and 5, a front portion and a back portion of the display apparatus 100 can be a mirror image of each other.

Exemplary Embodiments of the Beret Display

Figure 6:
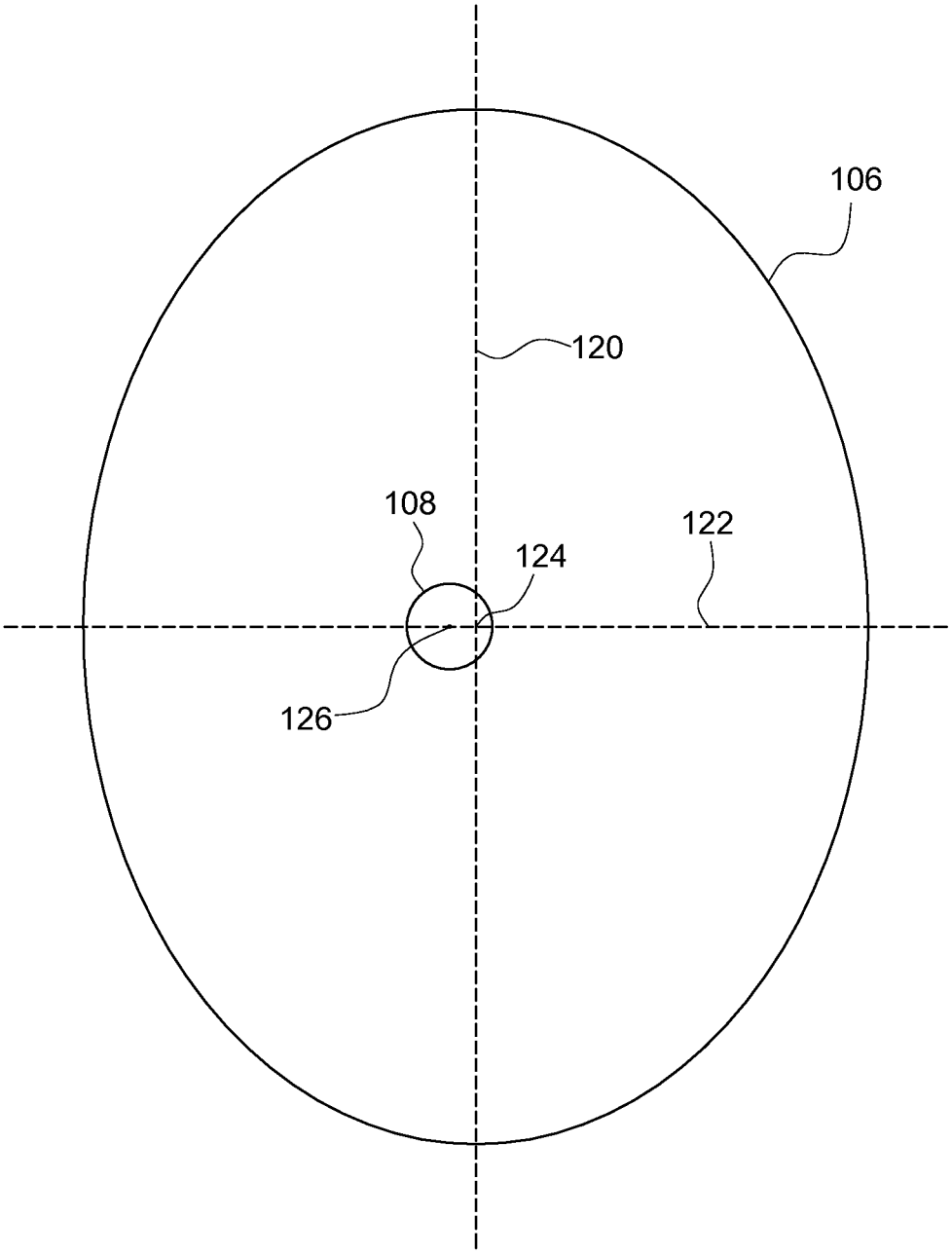
FIG. 6 is a bottom view of a beret display member according to one embodiment of the present invention.

Referring to FIG. 6, a detailed diagram of the member 106 is illustrated. FIG. 6 includes a bottom view of the member 106 including a location of the aperture 108, a major axis 120, and a minor axis 122. It is to be appreciated that the major axis 120 and the minor axis 122 are for illustrative purposes only. As shown, the member 106 can have a substantially elliptical cross-section. An intersection of the major axis 120 and the minor axis 122 can be a center point 124 on a bottom surface of the member 106.

In a first exemplary embodiment of a beret display apparatus, the beret display can be implemented to display berets having an interior circumference ranging from 21" to 22¾".

In the first exemplary embodiment, the member 106 can have a 7½" length by a 5¾" width by a 3" height. For instance, the major axis 120 can be 7½" long and the minor axis 122 can be 5¾". The member 106 can be manufactured from ABS plastic having a 3/16" thickness. Typically, the member 106 can be manufactured using one of a plurality of types of manufacturing processes including, but not limited to, injection molding, vacuum molding, thermoforming, etc. It is to be appreciated that the member 106 can be made from other rigid materials having varying thicknesses.

The member 106 can include the aperture 108 having a circular shape and a 1" diameter. A center point 126 of the aperture 108 can be located approximately a ¼" offset from the member center point 124. As shown in FIG. 6, the aperture center point 126 can be located on the minor axis 122. As such, when the rod 104 is coupled to the member 106, a center of the rod 104 can be offset by a ¼" from the center 124 of the member 106.

In a second exemplary embodiment of a beret display apparatus, the beret display can be implemented to display berets having an interior circumference ranging from 22⅞" to 24⅝".

In the second example, the member 106 can have a 8 3/16" length by a 6¼" width by a 3¼" height. For instance, the major axis 120 can be 8 3/16" long and the minor axis 122 can be 6¼". The member 106 can be manufactured from ABS plastic having a 3/16" thickness. It is to be appreciated that the member 106 can be made from other rigid materials having varying thicknesses.

Similar to the first exemplary embodiment, the member 106 in the second exemplary embodiment can include the aperture 108 having a circular shape and a 1" diameter. A center point 126 of the aperture 108 can be located approximately a ¼" offset from the member center point 124. As shown in FIG. 6, the aperture center point 126 can be located on the minor axis 122. As such, when the rod 104 is coupled to the member 106, a center of the rod 104 can be offset by a ¼" from the center 124 of the member 106.

In both exemplary embodiments, the sizing strip 110 can be implemented to provide a better fit for a beret worn by the member 106. Typically, a first sizing strip and a second sizing strip can be implemented. Both of the strips can generally be a rectangular strip of closed cell foam having a pressure sensitive adhesive on one side. The first sizing strip can be ¾" wide by 24" long by ⅛" thick. The second strip can be ¾" wide by 24" long by 3/16" thick. Typically, the strips can be cut to size to fit around the member 106.

Method of Implementing a Beret Display Apparatus

Typically, a fit of a beret on the member 106 can depend on an inside circumference of the beret. Most berets include a headband drawstring allowing the beret to be semi-adjustable. To ensure a correct fit after adjusting the headband drawstring, the drawstring can be secured with a knot. Since there can be variations to the interior circumference of the beret, a first user may have a different interior circumference from a second user given the same size beret. To account for varying sizes, the beret display apparatus can include different sizes of the member 106 and the sizing strips 110 to customize an individual fit for each user.

In a general implementation of the exemplary embodiments of the beret display apparatus 100, a user can first determine a size of their beret. For instance, after the user has fitted the beret to their head, the user can remove the beret and measure an interior circumference of the beret. After measuring the interior circumference, the user can select either the first exemplary embodiment or the second exemplary embodiment of the member 106 based on the interior circumference measurement. Generally, the first exemplary embodiment member can be implemented for berets having an interior circumference measuring between 21" to 22¾" and the second exemplary embodiment member can be implemented for berets having an interior circumference measuring between 22⅞" to 24⅝".

If the measured interior circumference is between approximately 21" to 22¾", the user can select the first exemplary embodiment of the member 106. Next, the user may determine if one of the sizing strips 110 are needed. For berets having an interior circumference between 21" to 21⅝", the member 106 can be used by itself. For interior circumferences between approximately 21¾" to 22¼", the first exemplary embodiment member 106 and the first sizing strip can be implemented. When the interior circumference is between approximately 22⅜" to 22¾", the first exemplary embodiment member 106 and the second sizing strip can be implemented.

If the measured interior circumference is between approximately 22⅞" to 24⅝", the second exemplary embodiment of the member 106 can be selected. Next, the user can determine if one of the sizing strips 110 is needed. For berets having an interior circumference between 22⅞" to 23½", the second exemplary embodiment member 106 can be used by itself. For interior circumferences between approximately 23⅝" to 24⅛", the second exemplary embodiment member 106 and the first sizing strip can be implemented. When the interior circumference is between approximately 24¼" to 24⅝", the second exemplary embodiment member 106 and the second sizing strip can be implemented.

After the user has selected the proper combination of the member 106 and the sizing strip 110, the user can place their beret on the member 106. The display apparatus 100 can be implemented to display and form the beret.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A beret display apparatus comprising:

a base;

a member adapted to wear a beret, the member having a domed shape defined by a substantially elliptical cross-section with a major axis and a minor axis; and a rod coupled to the base and the member, the rod being coupled to the member offset along the minor axis in relation to an intersection of the major axis and the minor axis of the member.

2. The apparatus of claim 1, wherein the apparatus further includes a strip of material that increases a circumference of the member.

3. The apparatus of claim 2, wherein the strip has a substantially rectangular shape and includes an adhesive on one side.

4. The apparatus of claim 3, wherein the member wears berets having an interior circumference between 21 inches to 22¾ inches.

5. The apparatus of claim 4, wherein the strip is coupled to the member for berets having an interior circumference between 21¾ inches to 22¼ inches, the strip having a ⅛ inch thickness.

6. The apparatus of claim 4, wherein the strip is coupled to the member for berets having an interior circumference between 22⅜ inches to 22¾ inches, the strip having a 3/16 inch thickness.

7. The apparatus of claim 3, wherein the member wears berets having an interior circumference between 22⅞ inches to 24⅝ inches.

8. The apparatus of claim 7, wherein the strip is coupled to the member for berets having an interior circumference between 23⅝ inches to 24⅛ inches, the strip having a ⅛ inch thickness.

9. The apparatus of claim 7, wherein the strip is coupled to the member for berets having an interior circumference between 24¼ inches to 24⅝ inches, the strip having a 3/16 inch thickness.

10. The apparatus of claim 1, wherein the member includes an aperture for receiving the rod.

11. The apparatus of claim 10, wherein the aperture is located offset from the intersection of the major axis and the minor axis of the member.

12. A combination comprising:

the beret display apparatus of claim 1; and a beret.

13. A beret display apparatus comprising:

a base;

a member having a domed shape with a bottom surface of the member having a substantially elliptical cross-section, the substantially elliptical cross-section being defined by a major axis and a minor axis;

a rod coupled to the base and the member, the rod being coupled to the bottom surface of the member offset along the minor axis in relation to an intersection of the major axis and the minor axis wherein a center of the rod is located approximately a ¼ inch along the minor axis from the intersection of the major axis and the minor axis when the rod is coupled to the bottom surface of the member.

14. The apparatus of claim 13, wherein the member measures 7½" along the major axis, 5¾" along the minor axis, and has a 3" height.

15. The apparatus of claim 14, wherein the apparatus further includes a substantially rectangular strip being ¾" wide by 24" long by ⅛" thick, the strip having an adhesive on one side.

16. The apparatus of claim 14, wherein the apparatus further includes a substantially rectangular strip being ¾" wide by 24" long by 3/16" thick, the strip having an adhesive on one side.

17. The apparatus of claim 13, wherein the member measures 8 3/16" along the major axis, 6¼" along the minor axis, and has a 3¼" height.

18. The apparatus of claim 17, wherein the apparatus further includes a substantially rectangular strip being ¾" wide by 24" long by ⅛" thick, the strip having an adhesive on one side.

19. The apparatus of claim 17, wherein the apparatus further includes a substantially rectangular strip being ¾" wide by 24" long by 3/16" thick, the strip having an adhesive on one side.

20. A combination for displaying a beret, the combination comprising:

a base;

a first domed member having a bottom surface defined by a substantially elliptical cross-section with a major axis and a minor axis, the first domed member measuring 7½" along the major axis, 5¾" along the minor axis, and having a 3" height;

a second domed member having a bottom surface defined by a substantially elliptical cross-section with a major axis and a minor axis, the second domed member measuring 8 3/16" along the major axis, 6¼" along the minor axis, and having a 3¼" height;

a rod coupled to the base, the rod being coupled to a bottom surface of a domed member selected from the group consisting of the first domed member and the second domed member;

a first substantially rectangular strip of material being ¾" wide by 24" long by ⅛" thick and having an adhesive on one side; and a second substantially rectangular strip of material being ¾" wide by 24" long by 3/16" thick and having an adhesive on one side;

wherein a center of the rod is located approximately a ¼ inch along the minor axis from an intersection of the major axis and minor axis when the rod is coupled to the bottom surface of the first domed member and the second domed member.

* * * * *